US008994595B2

(12) United States Patent
Huang et al.

(10) Patent No.: US 8,994,595 B2
(45) Date of Patent: Mar. 31, 2015

(54) MULTI-FREQUENCY ANTENNA

(75) Inventors: Chih-Yung Huang, Taichung (TW); Kuo-Chang Lo, Miaoli County (TW); Sy-Ben Wang, Hsinchu County (TW)

(73) Assignee: Arcadyan Technology Corp., Hsinchu (TW)

( * ) Notice: Subject to any disclaimer, the term of this patent is extended or adjusted under 35 U.S.C. 154(b) by 158 days.

(21) Appl. No.: 13/530,666

(22) Filed: Jun. 22, 2012

(65) Prior Publication Data

US 2013/0009845 A1 Jan. 10, 2013

(30) Foreign Application Priority Data

Jul. 6, 2011 (TW) ..... 100123960 A

(51) Int. Cl.
*H01Q 9/42* (2006.01)
*H01Q 1/12* (2006.01)
*H01Q 1/24* (2006.01)

(52) U.S. Cl.
CPC . *H01Q 9/42* (2013.01); *H01Q 1/243* (2013.01)
USPC ..... 343/702; 343/700 MS

(58) Field of Classification Search
CPC ..... H01Q 1/38; H01Q 1/243
USPC ..... 343/700 MS, 702, 749, 860
See application file for complete search history.

(56) References Cited

U.S. PATENT DOCUMENTS

2007/0296636 A1* 12/2007 Lee ..... 343/702
2010/0164830 A1* 7/2010 Huang et al. ..... 343/846
2011/0122042 A1* 5/2011 Huang et al. ..... 343/860
2011/0205138 A1* 8/2011 Yanagi et al. ..... 343/845
2012/0146865 A1* 6/2012 Hayashi et al. ..... 343/750

FOREIGN PATENT DOCUMENTS

CN 102110887 A 6/2011
EP 2204880 A1 7/2010

OTHER PUBLICATIONS

Office action from Chinese Patent Office in a counterpart Chinese Patent Application No. 100037, Dated Feb. 21, 2014.

* cited by examiner

*Primary Examiner* — Sue A Purvis
*Assistant Examiner* — Daniel J Munoz
(74) *Attorney, Agent, or Firm* — The PL Law Group, PLLC

(57) ABSTRACT

An antenna for receiving and transmitting a signal is provided. The antenna includes a connection portion receiving and transmitting the signal, a first radiation portion and a second radiation portion. The connection portion includes a first end, a second end and a third end, wherein the first end is configured at a first distance from a ground. The first radiation portion is connected to the second end, and includes at least one folding area forming thereon at least one folding segment, wherein the folding segment and the connection portion have therebetween a shortest distance being a second distance. The second radiation portion is connected to the third end.

20 Claims, 8 Drawing Sheets

MULTI-FREQUENCY ANTENNA

CROSS REFERENCE TO RELATED APPLICATIONS

The application claims the benefit of Taiwan Patent Application No. 100123960, filed on Jul. 6, 2011, at the Taiwan Intellectual Property Office, the disclosures of which are incorporated herein in their entirety by reference.

FIELD OF THE INVENTION

The present invention relates to a mini multi-frequency antenna, especially to an antenna able to work in a WiFi local area network (LAN) at the frequency of 2.4~2.5 GHz.

BACKGROUND OF THE INVENTION

As the wireless communication technologies become mature, plenty of new information products have been developed. Various wireless communication networks have become ones of the most important routes by the public to exchange voices, text messages, data, information, video files, etc. Transmitting and receiving these electronic data, information or files carried by an electromagnetic wave in the wireless communication necessitate the antenna.

Therefore, the antenna is one of the most important components to affect the quality of the communication. Broadly reviewing all the products and technologies of the mobile communication up to now, no matter how advanced the technologies, what integrations of components and modules and what changes to the industrial designs, the design of the antenna is still one of the most important key technologies. The antenna designs with excellent performances can effectively raise the quality of the communication. A single antenna with good antenna design should be able to cover various frequency bands required in various wireless communication networks. In addition, for the availability to the portable wireless communication devices, e.g. cellular phones, personal digital assistants, etc., carried by the users, the antennas with mini sizes should be realized.

As shown in FIG. 1, a planar inverted-F antenna (PIFA) in the prior art is used for the wireless communication network. However, when this kind of antenna is used for as a multi-frequency antenna, its planar radiation portion occupy a large area, and the distance between the radiation plane and the substrate surface is related to the frequency and bandwidth of the antenna and can not be arbitrarily adjusted.

This kind of antenna requires large power to accomplish the transmission function and large space as well, and accordingly the volume occupied by this kind of antenna in the prior art can not be effectively reduced.

SUMMARY OF THE INVENTION

For solving the issue that the volume occupied by the antenna in the prior can not be effective reduced, the present invention provides an excellent antenna with effectively reduced volume and the ability to work as a single mini-sized multi-frequency antenna at various frequency bands in the various wireless communication networks.

In accordance with one aspect of the present invention, an antenna for receiving and transmitting a signal is provided. The antenna includes a connection portion receiving and transmitting the signal, a first radiation portion and a second radiation portion. The connection portion includes a first end, a second end and a third end, wherein the first end is configured at a first distance from a ground. The first radiation portion is connected to the second end, and includes at least a folding area forming thereon at least a folding segment, wherein the folding segment and the connection portion have therebetween a shortest distance being a second distance. The second radiation portion is connected to the third end.

In accordance with another aspect of the present invention, an antenna for receiving and transmitting a signal is provided. The antenna comprises a signal feeding portion receiving and transmitting the signal, and a first frequency adjusting portion connected to the signal feeding portion. The first frequency adjusting portion includes a first extending portion and a second extending portion extended from the first extending portion and pointing toward the signal feeding portion.

In accordance with a further aspect of the present invention, an antenna for receiving and transmitting a signal is provided. The antenna comprises a signal feeding portion and a coupled portion. The signal feeding portion receives and transmits the signal, and includes a feeding end having a first climax. The coupled portion includes a bottom end having a second climax for being coupled to an electronic communication device, wherein the first and the second climaxes have therebetween a distance being one of distances equal to and larger than 1 mm.

The above objects and advantages of the present invention will become more readily apparent to those ordinarily skilled in the art after reviewing the following detailed descriptions and accompanying drawings, in which:

DETAILED DESCRIPTION OF THE EXEMPLARY EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

First Embodiment

Before the manufacture of antennas, the required specifications, e.g. available communication frequency bands, pattern directions, gain, expected size of the antenna, etc., must be ascertained first to determine the antenna structure conforming to these required specification, and to select an appropriate feeding method. Then, the shape, size and other parameters of the antenna are primarily designed.

Although the conventional PIFA has advantages of low configuration, simple manufacturing processes and availability of operation at multi frequencies, the conventional PIFA has a drawback that the bandwidth is too narrow. For enlarging the bandwidth, the present invention develops a new design of the antenna in view of the distance between the PIFA metal plane and ground, and the distance between the feeding point and the radiation portion of the PIFA for minimizing the size of the antenna.

Figure 1:
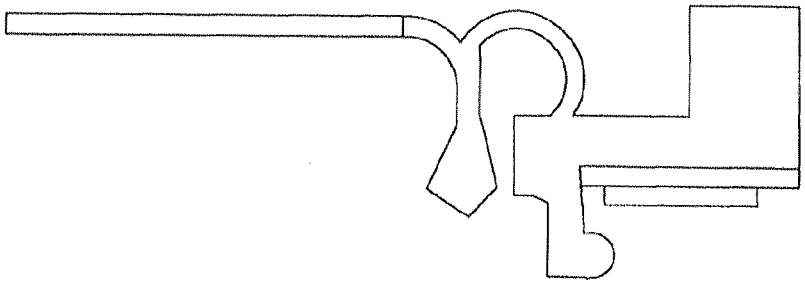
Fig. 1 (Prior Art)
FIG. 1 is the schematic diagram showing a planar inverted-F antenna for the wireless communication network in the prior art.
Figure 2:
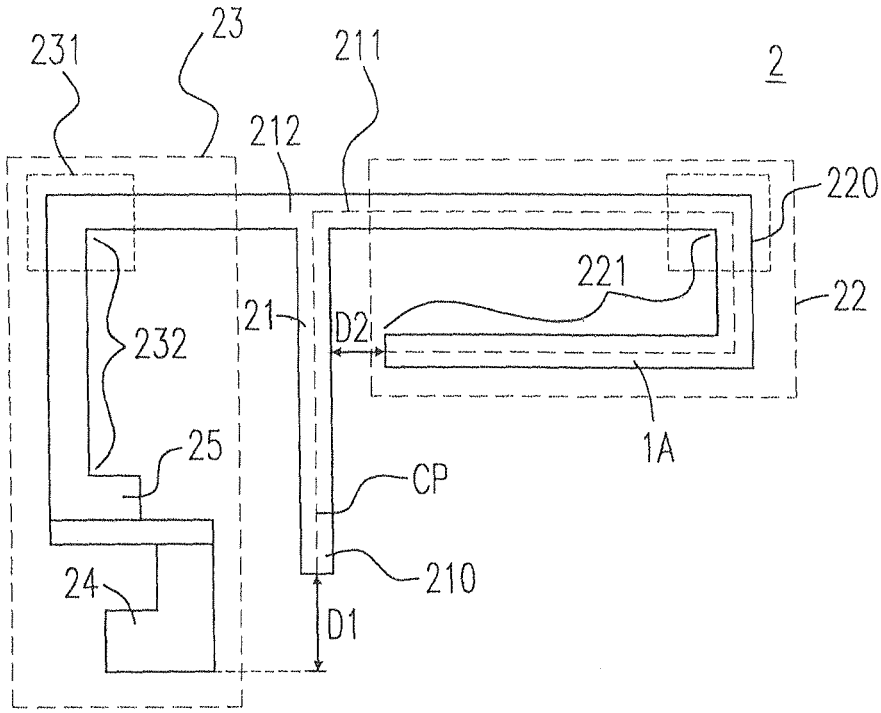
FIG. 2 is the schematic diagram showing an antenna in accordance with some embodiments of the present invention.

FIG. 2 shows an antenna of the present invention. As shown in FIG. 2, the antenna 2 can be a unipolar antenna formed by the inclusion of a conductive plane with uniform cross sectional thickness and three portions after folding. The antenna 2 has a connection portion 21, a first radiation portion 22 and a second radiation portion 23. A feeding point CP is configured in a lower edge of the connection portion 21 for receiving and transmitting a signal. The connection portion 21 has a first end 210 configured at a first distance D1, preferably equal to or larger than 1 mm, from the ground. The first radiation portion 22 is connected to the second end 211 of the connection portion 21. The first radiation portion 22 includes at least one folding area 220 to form at least one folding segment 221. There is the shortest distance, as a second distance D2 preferably equal to or larger than 1 mm, between the folding segment 221 and the connection portion 21. The second radiation portion 23 is connected to the third end 212 of the connection portion 21. The second radiation portion 23 includes at least one folding area 231 to form at least one folding segment 232, which is parallel to the connection portion 21.

The folding structures of these radiation portions are described in detail as follows. The folding angle of the folding area 220 of the first radiation portion 22 is a right angle, i.e. 90 degree, and so is that of folding area 231 of the second radiation portion 23.

Through the structure of the antenna 2, the path length from the feeding point CP of the connection portion 21 to the segment end of the folding segment 221 of the first radiation portion 22, i.e. the dash line denoted as the path 1A in FIG. 2, forms a resonance structure of a unipolar antenna, where the path length of the path 1A is designed to be equal to one fourth of the wavelength corresponding the frequency of 2.4 GHz so as to generate the stationery wave at the frequency of 2.4 GHz. Consequently, the antenna of the present embodiment is able to work at dual frequency bands of 2.4 and 2.5 GHz.

Figure 3:
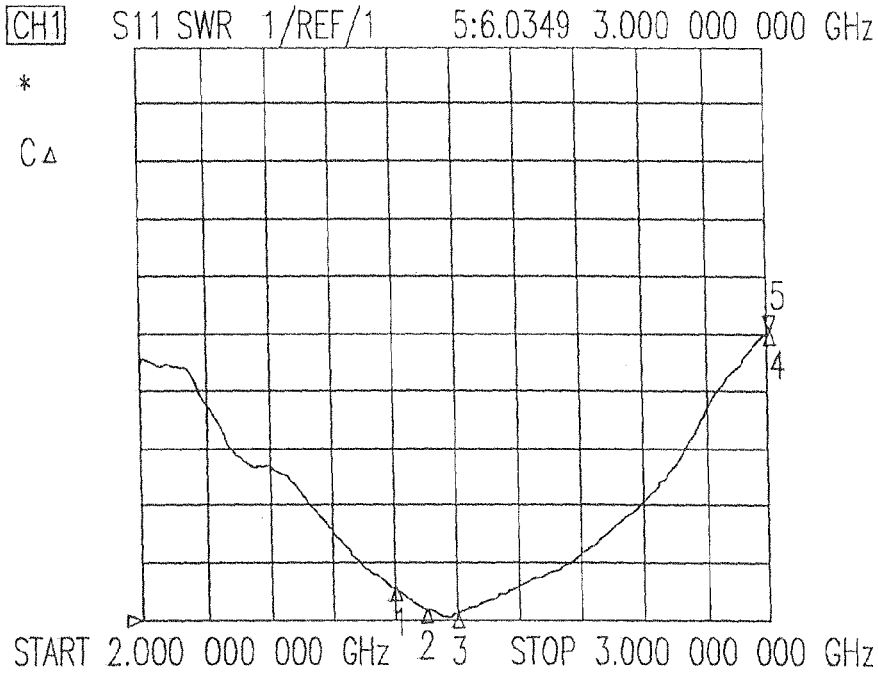
FIG. 3 is the schematic diagram showing frequency characteristics of an antenna able to generate specific stationery waves at frequencies of 2.4 and 2.5 GHz in accordance with some embodiments of the present invention.

FIG. 3 shows frequency characteristics of an antenna able to generate specific stationery waves at frequencies of both 2.4 and 2.5 GHz in accordance with some embodiments of the present invention. The abscissa of FIG. 3 represents frequency; while the ordinate thereof represents the magnitude of the frequency domain characteristics. For instance, the ordinate of FIG. 3 can be a voltage standing wave ratio (VSWR). As understood by the skilled person in the art, a local minimum of the voltage standing wave ratio in the frequency domain can stand for an available frequency band of the antenna, especially from the view of the radiation of the frequency domain.

Figure 4:
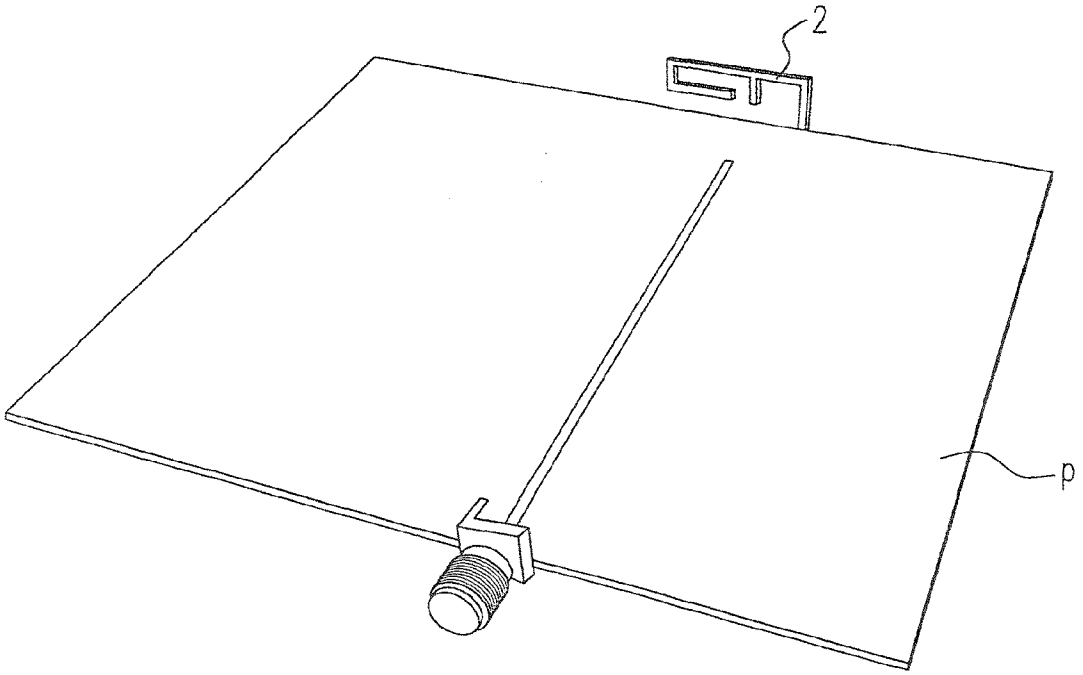
FIG. 4 is the schematic diagram showing an antenna installed in a circuit board in accordance with some embodiments of the present invention.

Due to the minimized size and the availability of large bandwidth, the antennas of the present invention can be widely applied to various portable communication devices, e.g. cellular phones, personal digital assistants (PDAs), lap top computers, etc. FIG. 4 shows an antenna 2 installed in a circuit board P in accordance with some embodiments of the present invention. As referring to FIGS. 2 and 4 together, the lower edge of the second radiation portion 23 of the antenna 2 is configured with a hook 24, which is to be embedded into the circuit board P for installing the antenna 2 onto the circuit board P.

In addition, since the radio wave encounters different impedances when transmitting along the different sections of the antenna system, e.g. radio station, feeding line, antenna, free space, etc., a ground end 25 is designed as disposed between the folding segment 232 of the second radiation portion 23 and the hook 24 located at the lower edge of the second radiation portion 23 for matching the impedances.

Figure 5A:
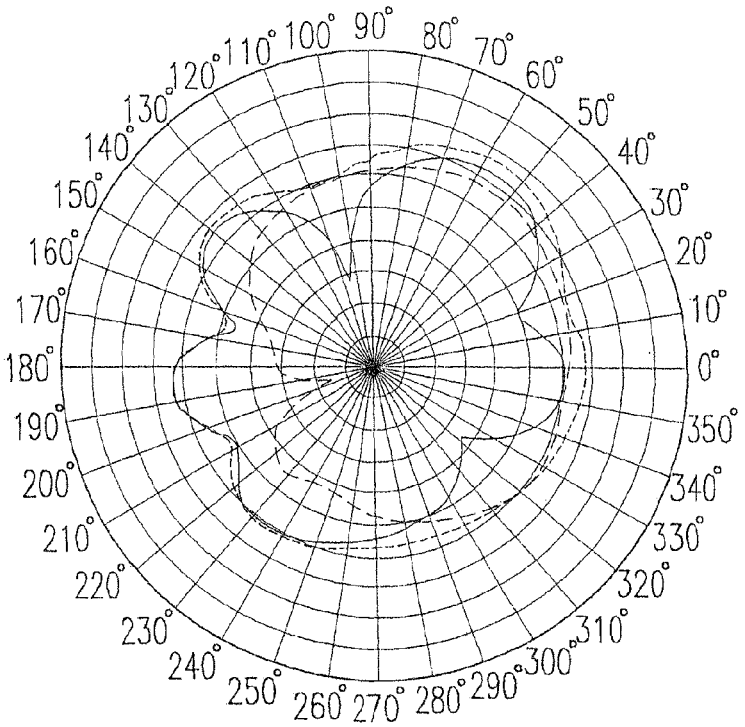
FIG. 5A-5C are the schematic diagrams showing radiation patterns in an X-Y plane, a Y-Z plane and an X-Z plane for a multi-frequency planar antenna at the frequencies of 2.4-2.5 GHz in accordance with the first embodiment of the present invention.
Figure 5B:
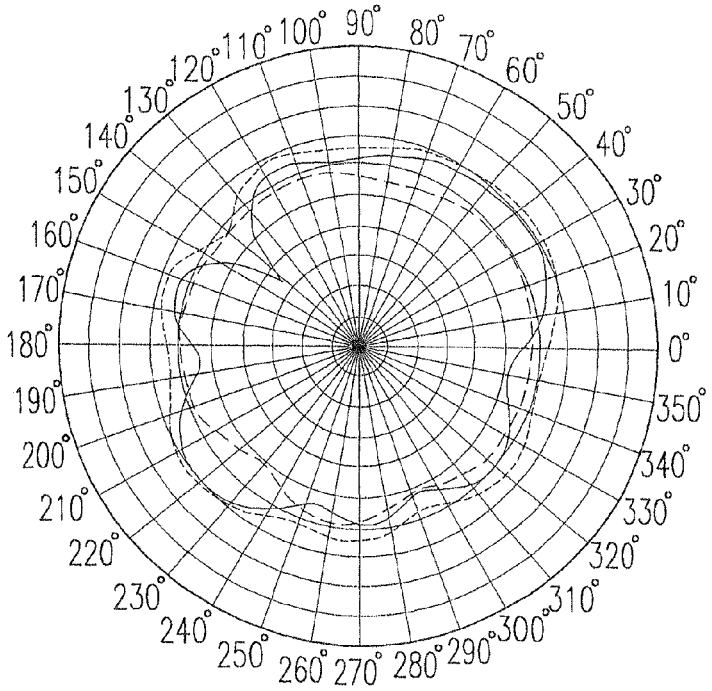
Figure 5C:
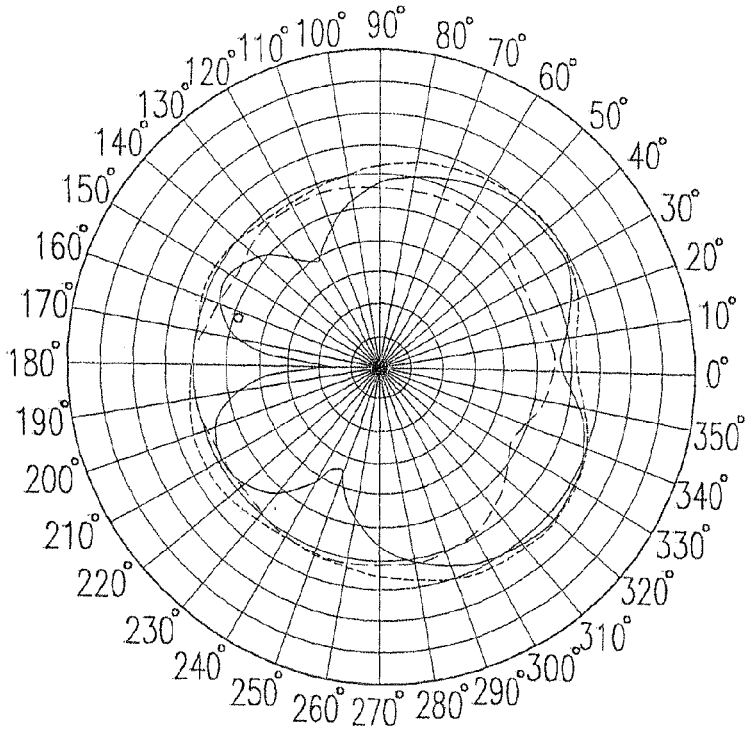

Besides, FIGS. 5A-5C show the radiation patterns in an X-Y plane, a Y-Z plane and an X-Z plane of a multi-frequency planar antenna at the frequencies of 2.4-2.5 GHz in accordance with the first embodiments of the present invention, respectively. As shown in the radiation patterns in FIGS. 5A-5C, the antenna provides omnidirectional radiation.

Second Embodiment

Figure 6:
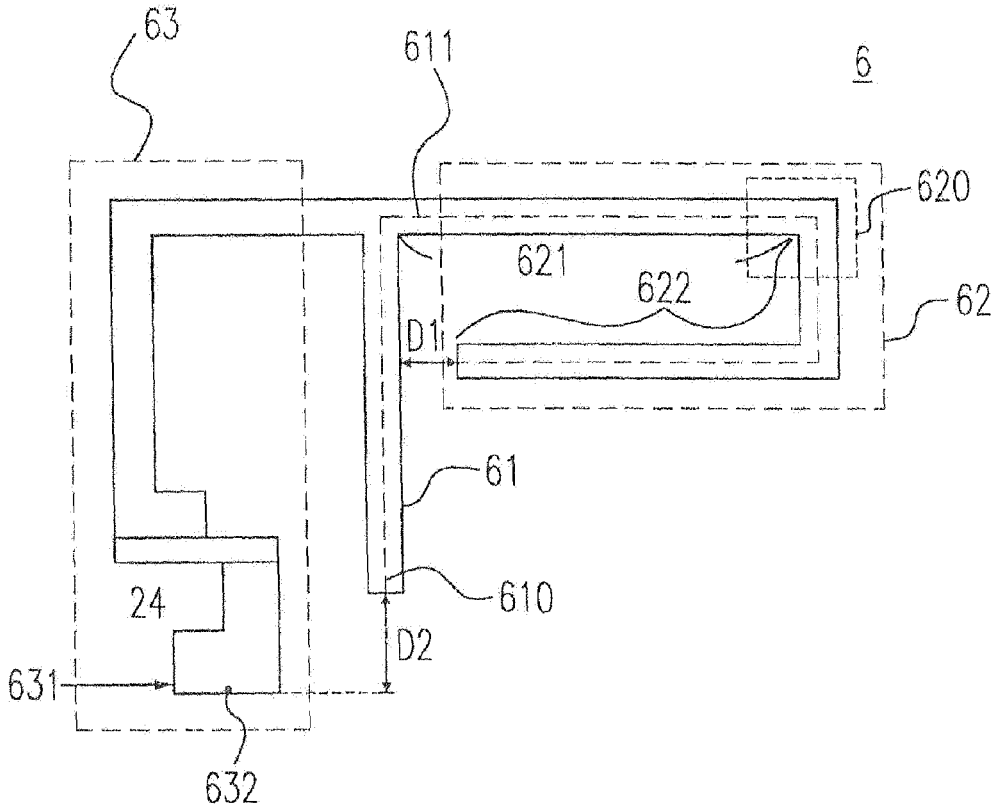
FIG. 6 is the schematic diagram showing another antenna in accordance with some embodiments of the present invention.

FIG. 6 shows an antenna in accordance with some embodiments of the present invention. As shown in FIG. 6, the antenna 6 includes a signal feeding portion 61 similar to the connection portion 21 in FIG. 2. The signal feeding portion 61 includes a first climax 610, i.e. feeding point CP, for receiving and transmitting a signal. The antenna 6 in FIG. 6 includes a first frequency adjusting portion 62 similar to the first radiation portion 22 in FIG. 2. The first frequency adjusting portion 62 is connected to the signal feeding portion 61 and includes a first extending portion 621 and a second extending portion 622. The first extending portion 621 is defined as the portion from the second end 611 of the signal feeding portion 61 to the folding area 620 of the first frequency adjusting portion 61. The second extending portion 622 is extended from the first extending portion 621 at the folding area 620 and points toward the signal feeding portion 61. There is a shortest distance as a first distance D1, equal to or smaller than 1 mm, between the second extending portion 622 and the signal feeding portion 61. The antenna 6 in FIG. 6 includes a coupled portion 63 similar to the second radiation portion 23 in FIG. 2. The coupled portion 63 can be coupled to an electronic communication device, and includes bottom end 631 having a second climax 632. The first climax 610 and the second climax 632 have therebetween a second distance D2 equal to or smaller than 1 mm.

Some embodied examples of the present invention are described in the following.

1. An antenna for receiving and transmitting a signal is provided. The antenna comprises a connection portion receiving and transmitting the signal, a first radiation portion and a second radiation portion. The connection portion includes a first end, a second end and a third end, wherein the first end is configured at a first distance from a ground. The first radiation portion is connected to the second end, and includes at least a folding area forming thereon at least a folding segment, wherein the folding segment and the connection portion have therebetween a shortest distance being a second distance. The second radiation portion is connected to the third end.

2. In an antenna according to Example 1, each of the folding areas of the first radiation portion and the second radiation portion has a folding angle equal to a right angle.

3. In an antenna according to any one of the above examples, the second radiation portion includes at least a folding area having at least a folding segment parallel to the connection portion, and the second radiation portion has a lower edge configured with a hook to be embedded into a circuit board for installing the antenna onto the circuit board.

4. An antenna according to any one of the above examples further comprises a ground end disposed between the folding area of the second radiation portion and the hook for matching an impedance.

5. An antenna according to any one of the above examples has a path and an operating frequency corresponding to an operating wavelength, wherein the folding segment of the first radiation portion has a segment end, and the path between the first end and the segment end of the folding segment of the first radiation portion has a path length equal to one-fourth of the operating wavelength.

6. In an antenna according to any one of the above examples, each of the first and the second distances is one of distances equal to and larger than 1 mm.

7. In an antenna according to any one of the above examples, the connection portion, the first radiation portion and the second radiation portion are made in one piece.

8. In an antenna according to any one of the above examples, the antenna has an operating bandwidth in a range of 2.4 to 2.5 GHz.

9. An antenna for receiving and transmitting a signal is provided. The antenna comprises a signal feeding portion receiving and transmitting the signal and a first frequency adjusting portion. The first frequency adjusting portion is connected to the signal feeding portion, and includes a first extending portion and a second extending portion extended from the first extending portion and pointing toward the signal feeding portion.

10. An antenna according to any one of the above examples further comprises a second frequency adjusting portion coupled to an electronic communication device, connected to the signal feeding portion, and including a bottom end having a second climax, wherein the signal feeding portion has a first climax, and the first and the second climaxes have therebetween a distance being one of distances equal to and larger than 1 mm.

11. In an antenna according to any one of the above examples, the first and the second extending portions have an included angle equal to a right angle, and the second frequency adjusting portion includes at least a folding area having a folding angle equal to the right angle.

12. In an antenna according to any one of the above examples, the second frequency adjusting portion has a lower edge configured with a hook to be embedded into a circuit board for installing the antenna onto the circuit board, and the antenna further comprises a ground end disposed between the folding area of the second frequency adjusting portion and the hook for matching an impedance.

13. In an antenna according to Claim 10, the signal feeding portion, the first frequency adjusting portion and the second frequency adjusting portion are made in one piece, and the antenna has an operating bandwidth in a range of 2.4 to 2.5 GHz.

14. An antenna according to any one of the above examples has a path and an operating frequency corresponding to an operating wavelength, wherein the signal feeding portion has a first end configured at a first distance from a ground, the second extending portion has an extending end, the path is formed from the first end to the extending end and has a path length equal to one-fourth of the operating wavelength, the signal feeding portion and the second extending portion have therebetween a shortest distance being a second distance, and each of the first and the second distances is one of distances equal to and larger than 1 mm.

15. An antenna for receiving and transmitting a signal is provided. The antenna comprises a signal feeding portion and a coupled portion. The signal feeding portion receives and transmits the signal, and includes a feeding end having a first climax. The coupled portion includes a bottom end has a second climax for being coupled to an electronic communication device, wherein the first and the second climaxes have therebetween a distance being one of distances equal to and larger than 1 mm.

16. An antenna according to any one of the above examples further comprises a frequency adjusting portion connected to the signal feeding portion and including a first extending portion and a second extending portion extended from the first extending portion and pointing toward the signal feeding portion.

17. In an antenna according to any one of the above examples, the first and the second extending portions have an included angle equal to a right angle, and the coupled portion includes at least a folding area having a folding angle equal to the right angle.

18. In an antenna according to any one of the above examples, the coupled portion has a lower edge configured with a hook to be embedded into a circuit board for installing the antenna onto the circuit board, and the antenna further comprises a ground end disposed between the folding area of the coupled portion and the hook for matching an impedance.

19. In an antenna according to any one of the above examples, the signal feeding portion, the coupled portion and the frequency adjusting portion are made in one piece, and the antenna has an operating bandwidth in a range of 2.4 to 2.5 GHz.

20. An antenna according to any one of the above examples has a path and an operating frequency corresponding to an operating wavelength, wherein the signal feeding portion has a first end configured at a first distance from a ground, the second extending portion has an extending end, the path is formed from the first end to the extending end and has a path length equal to one-fourth of the operating wavelength, the signal feeding portion and the second extending portion have therebetween a shortest distance being a second distance, and each of the first and the second distances is one of distances equal to and larger than 1 mm.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An antenna for receiving and transmitting a signal, comprising:

a connection portion receiving and transmitting the signal, and including a first end, a second end and a third end, wherein the first end is configured at a first distance from a ground;

a first radiation portion connected to the second end, and including at least a first folding area forming thereon at least a first folding segment, wherein the first folding segment and the connection portion have therebetween a shortest distance being a second distance;

a second radiation portion connected to the third end; and a ground end, wherein the second radiation portion includes a second folding area having a second folding segment parallel to the connection portion, and the second radiation portion has a lower edge configured with a hook;

the lower edge has a first side portion and a second side portion opposite to the first side portion, wherein the second side portion is disposed between the first side portion and the connection portion;

the ground end extends from the second folding segment to point toward the connection portion, and is entirely disposed on the first side portion; and the hook entirely extends from the second side portion, and is disposed under the lower edge.

2. An antenna of claim 1, wherein each of the first and the second folding areas has a folding angle equal to a right angle.

3. An antenna of claim 1, wherein the hook is to be embedded into a circuit board for installing the antenna onto the circuit board.

4. An antenna of claim 1, wherein the ground end is disposed between the second folding area of the second radiation portion and the hook for matching an impedance.

5. An antenna of claim 1, having a path and an operating frequency corresponding to an operating wavelength, wherein the first folding segment of the first radiation portion has a segment end, and the path between the first end and the segment end of the first folding segment of the first radiation portion has a path length equal to one-fourth of the operating wavelength.

6. An antenna of claim 1, wherein each of the first and the second distances is one of distances equal to and larger than 1 mm.

7. An antenna of claim 1, wherein the connection portion, the first radiation portion and the second radiation portion are made in one piece.

8. An antenna of claim 1, wherein the antenna has an operating bandwidth in a range of 2.4 to 2.5 GHz.

9. An antenna for receiving and transmitting a signal, comprising:

a signal feeding portion receiving and transmitting the signal;

a first frequency adjusting portion connected to the signal feeding portion, and including:

a first extending portion; and a second extending portion extending from the first extending portion, and pointing toward the signal feeding portion;

a second frequency adjusting portion including:

a third extending portion extending from the signal feeding portion; and a fourth extending portion extending from the third extending portion, and parallel to the signal feeding portion; and a ground end, wherein the second frequency adjusting portion has a lower edge configured with a hook;

the lower edge has a first side portion and a second side portion opposite to the first side portion, wherein the second side portion is disposed between the first side portion and the signal feeding portion;

the ground end extends from the fourth extending portion to point toward the connection portion, and is entirely disposed on the first side portion; and the hook entirely extends from the second side portion, and is disposed under the lower edge.

10. An antenna of claim 9, wherein the second frequency adjusting portion is coupled to an electronic communication device, is connected to the signal feeding portion, and includes a bottom end having a second climax, wherein the signal feeding portion has a first climax, and the first and the second climaxes have therebetween a distance being one of distances equal to and larger than 1 mm.

11. An antenna of claim 10, wherein the first and the second extending portions have an included angle equal to a right angle, and the second frequency adjusting portion includes at least a folding area having a folding angle equal to the right angle.

12. An antenna of claim 11, wherein the hook is to be embedded into a circuit board for installing the antenna onto the circuit board, and the ground end is disposed between the folding area of the second frequency adjusting portion and the hook for matching an impedance.

13. An antenna of claim 10, wherein the signal feeding portion, the first frequency adjusting portion and the second frequency adjusting portion are made in one piece, and the antenna has an operating bandwidth in a range of 2.4 to 2.5 GHz.

14. An antenna of claim 9, having a path and an operating frequency corresponding to an operating wavelength, wherein the signal feeding portion has a first end configured at a first distance from a ground, the second extending portion has an extending end, the path is formed from the first end to the extending end and has a path length equal to one-fourth of the operating wavelength, the signal feeding portion and the second extending portion have therebetween a shortest distance being a second distance, and each of the first and the second distances is one of distances equal to and larger than 1 mm.

15. An antenna for receiving and transmitting a signal, comprising:

a signal feeding portion receiving and transmitting the signal, and including a feeding end having a first climax; and a coupled portion including a bottom end having a second climax for being coupled to an electronic communication device, wherein the first and the second climaxes have therebetween a distance being one of distances equal to and larger than 1 mm; and a ground end, wherein the coupled portion further includes:

a first extending portion extending from the signal feeding portion; and a second extending portion extending from the first extending portion, and parallel to the signal feeding portion;

the coupled portion has a lower edge configured with a hook;

the lower edge has a first side portion and a second side portion opposite to the first side portion, wherein the second side portion is disposed between the first side portion and the signal feeding portion;

the ground end extends from the second extending portion to point toward the connection portion, and is entirely disposed on the first side portion; and the hook entirely extends from the second side portion, and is disposed under the lower edge.

16. An antenna of claim 15, further comprising:

a frequency adjusting portion connected to the signal feeding portion, and including:

a third extending portion; and a fourth extending portion extended from the third extending portion, and pointing toward the signal feeding portion.

17. An antenna of claim 16, wherein the third and the fourth extending portions have an included angle equal to a right angle, and the coupled portion includes at least a folding area having a folding angle equal to the right angle.

18. An antenna of claim 16, wherein the hook is to be embedded into a circuit board for installing the antenna onto the circuit board, and the ground end is disposed between the folding area of the coupled portion and the hook for matching an impedance.

19. An antenna of claim 16, wherein the signal feeding portion, the coupled portion and the frequency adjusting portion are made in one piece, and the antenna has an operating bandwidth in a range of 2.4 to 2.5 GHz.

20. An antenna of claim 16, having a path and an operating frequency corresponding to an operating wavelength, wherein the signal feeding portion has a first end configured at a first distance from a ground, the fourth extending portion has an extending end, the path is formed from the first end to the extending end and has a path length equal to one-fourth of the operating wavelength, the signal feeding portion and the fourth extending portion have therebetween a shortest distance being a second distance, and each of the first and the second distances is one of distances equal to and larger than 1 mm.

* * * * *